US010794186B2

(12) United States Patent
Lindsey

(10) Patent No.: US 10,794,186 B2
(45) Date of Patent: Oct. 6, 2020

(54) ROTARY PISTON AND CYLINDER DEVICES

(71) Applicant: Lontra Limited, Warwickshire (GB)

(72) Inventor: Stephen F. Lindsey, Richmond (GB)

(73) Assignee: Lontra Limited, Warwickshire (GB)

( * ) Notice: Subject to any disclaimer, the term of this patent is extended or adjusted under 35 U.S.C. 154(b) by 161 days.

(21) Appl. No.: 15/864,848

(22) Filed: Jan. 8, 2018

(65) Prior Publication Data

US 2018/0128105 A1 May 10, 2018

Related U.S. Application Data

(63) Continuation of application No. 13/060,752, filed as application No. PCT/GB2009/051093 on Aug. 28, 2009, now Pat. No. 9,879,534.

(30) Foreign Application Priority Data

Aug. 29, 2008 (GB) ..... 0815766.1

(51) Int. Cl.

| | |
|---|---|
| ***F01C 3/02*** | (2006.01) |
| ***F01C 21/00*** | (2006.01) |
| ***F01C 21/10*** | (2006.01) |
| *F04C 15/00* | (2006.01) |

(52) U.S. Cl.

CPC ..... *F01C 3/02* (2013.01); *F01C 21/008* (2013.01); *F01C 21/10* (2013.01); *F01C 3/025* (2013.01); *F04C 15/0061* (2013.01); *F04C 2240/30* (2013.01); *Y10T 74/1836* (2015.01)

(58) Field of Classification Search

CPC ..... F01C 3/02; F01C 21/008; F01C 21/10; F01C 21/00

See application file for complete search history.

(56) References Cited

U.S. PATENT DOCUMENTS

| | | | | |
|---|---|---|---|---|
| 4,391,574 A | | 7/1983 | Medel, Jr. et al. | |
| 4,771,655 A | | 9/1988 | Kawamura | |
| 5,131,359 A | * | 7/1992 | Gomm | F01C 3/02 123/248 |
| 5,133,317 A | | 7/1992 | Sakita | |
| 5,192,201 A | * | 3/1993 | Beben | F01C 1/067 123/245 |

(Continued)

FOREIGN PATENT DOCUMENTS

| | | |
|---|---|---|
| DE | 31 46 782 A1 | 6/1983 |
| DE | 40 36 768 A1 | 5/1992 |

(Continued)

OTHER PUBLICATIONS

International Search Report, dated Jul. 6, 2010, pp. 1-6, issued in PCT International Application No. PCT/GB2009/051093, European Patent Office, Rijswijk, The Netherlands.

*Primary Examiner* — David M Fenstermacher

(74) *Attorney, Agent, or Firm* — Brinks Gilson & Lione

(57) ABSTRACT

A transmission assembly for a rotary piston and cylinder device, comprising a rotor including a piston, a stator, a shutter including a slot to receive the piston, and a first gear and a gear sub-assembly, the first gear connectable to a rotatably mounted shutter of the device, and the first gear extending from a side of the shutter, and the first gear connected to the gear sub-assembly which converts rotation to an axis of rotation different to that of the shutter.

23 Claims, 14 Drawing Sheets

(56) References Cited

U.S. PATENT DOCUMENTS

| | | | | |
|---|---|---|---|---|
| 6,289,867 | B1 * | 9/2001 | Free | F01C 1/063 123/211 |
| 6,446,595 | B1 | 9/2002 | Sakita | |
| 6,457,452 | B1 * | 10/2002 | Sakita | F01C 1/077 123/245 |
| 6,668,787 | B2 * | 12/2003 | Masters | F01C 9/002 123/245 |
| 6,886,527 | B2 * | 5/2005 | Regev | F01C 1/077 123/234 |
| 6,948,473 | B2 * | 9/2005 | Udy | F01C 1/063 123/245 |
| 6,962,137 | B2 * | 11/2005 | Udy | F01C 1/063 123/245 |
| 7,814,882 | B2 * | 10/2010 | Sakita | F01C 1/07 123/241 |
| 7,827,956 | B2 * | 11/2010 | Ambardekar | F01C 1/077 123/245 |
| 7,834,499 | B2 | 11/2010 | Acosta et al. | |
| 8,408,179 | B2 * | 4/2013 | Manganaro | F01C 1/077 123/243 |
| 8,534,259 | B2 * | 9/2013 | Eckhardt | F01C 1/07 123/212 |
| 8,689,763 | B2 * | 4/2014 | Pandolfo | F01C 11/002 123/200 |
| 9,879,534 | B2 * | 1/2018 | Lindsey | F01C 3/02 |

FOREIGN PATENT DOCUMENTS

| | | |
|---|---|---|
| DE | 198 46 871 A1 | 4/2000 |
| FR | 2 531 744 | 2/1984 |

* cited by examiner

ROTARY PISTON AND CYLINDER DEVICES

CROSS REFERENCE TO RELATED APPLICATIONS

This application is a continuation application of U.S. application Ser. No. 13/060,752, entitled "ROTARY PISTON AND CYLINDER DEVICES", filed Apr. 11, 2011, which is a 371 nationalization of and claims the benefit of the filing date of International Application number PCT/GB2009/051093, entitled "ROTARY PISTON AND CYLINDER DEVICES", filed Aug. 28, 2009 which claims the benefit of the filing date of United Kingdom Application number 0815766.1, entitled "ROTARY PISTON AND CYLINDER DEVICES," filed Aug. 29, 2008, the entire contents of each of these applications is incorporated by reference in their entirety.

FIELD

The present invention relates generally to rotary piston and cylinder devices.

BACKGROUND

Rotary piston and cylinder devices can take the form of an internal combustion engine, or a pump such as a supercharger or fluid pump, or as an expander such as a steam engine or turbine replacement.

A rotary piston and cylinder device comprises a rotor and a stator, the stator at least partially defining an annular cylinder space, the rotor is in the form of a ring, and the rotor comprising at least one piston which extends from the rotor ring into the annular cylinder space, in use the at least one piston is moved circumferentially through the annular cylinder space on rotation of the rotor relative to the stator, the rotor body being sealed relative to the stator, and the device further comprising cylinder space shutter means which is capable of being moved relative to the stator to a closed position in which the shutter means partitions the annular cylinder space, and to an open position in which the shutter means permits passage of the at least one piston, the cylinder space shutter means comprising a shutter disc.

The term 'piston' is used herein in its widest sense to include, where the context admits, a partition capable of moving relative to a cylinder wall, and such partition need not generally be of substantial thickness in the direction of relative movement but can often be in the form of a blade. The partition may be of substantial thickness or may be hollow.

The shutter disc may present a partition which extends substantially radially of the annular cylinder space.

Although in theory the shutter means could be reciprocable, it is preferred to avoid the use of reciprocating components, particularly when high speeds are required, and the shutter means is preferably at least one rotary shutter disc provided with at least one aperture which in the open condition of the shutter means is arranged to be positioned substantially in register with the circumferentially-extending bore of the annular cylinder space to permit passage of the at least one piston through the shutter disc.

The at least one aperture of the shutter is provided substantially radially in the shutter disc.

Preferably the axis of rotation of the rotor is not parallel to the axis of rotation of the shutter disc. Most preferably the axis of rotation of the rotor is substantially orthogonal to the axis of rotation of the shutter disc.

Preferably the piston is so shaped that it will pass through an aperture in the moving shutter means, without balking, as the aperture passes through the annular cylinder space. The piston is preferably shaped so that there is minimal clearance between the piston and the aperture in the shutter means, such that a seal is formed as the piston passes through the aperture. A seal is preferably provided on a leading or trailing surface or edge of the piston. In the case of a compressor a seal could be provided on a leading surface and in the case of an expander a seal could be provided on a trailing surface.

The rotor body is preferably rotatably supported by the stator rather than relying on co-operation between the pistons and the cylinder walls to relatively position the rotor body and stator.

It will be appreciated that a rotary piston and cylinder device is distinct from a conventional reciprocating piston device in which the piston is maintained coaxial with the cylinder by suitable piston rings which give rise to relatively high friction forces.

The rotor ring is preferably rotatably supported by suitable bearing means carried by the stator.

Preferably the stator comprises at least one inlet port and at least one outlet port.

Preferably at least one of the ports is substantially adjacent to the shutter means.

Preferably the ratio of the angular velocity of the rotor to the angular velocity of the shutter disc is 1:1.

We seek to provide a transmission assembly for rotary piston and cylinder devices.

SUMMARY

According to one aspect of the invention there is provided a transmission assembly for a rotary piston and cylinder device, comprising a first gear and a gear sub-assembly, the first gear connectable to a rotatably mounted shutter of the device, and the first gear extending from a side of the shutter, and the first gear connected to the gear sub-assembly which converts rotation to an axis of rotation different to that of the shutter.

According to another aspect of the invention there is provided a rotary piston and cylinder device, comprising a rotor and an annular cylinder space, and the rotor is provided with a housing portion with a housing portion which extends away from the annular cylinder space, which is substantially co-axial with the axis of rotation of the rotor, and the housing portion is rotationally connected to a transmission assembly to transmit rotation from the rotor to a rotatable shutter of the device, and the transmission assembly is at least partially enclosed by the housing portion.

BRIEF DESCRIPTION OF THE DRAWINGS

Various embodiments of the invention will now be described, by way of example only, in which.

DETAILED DESCRIPTION

Figure 1:
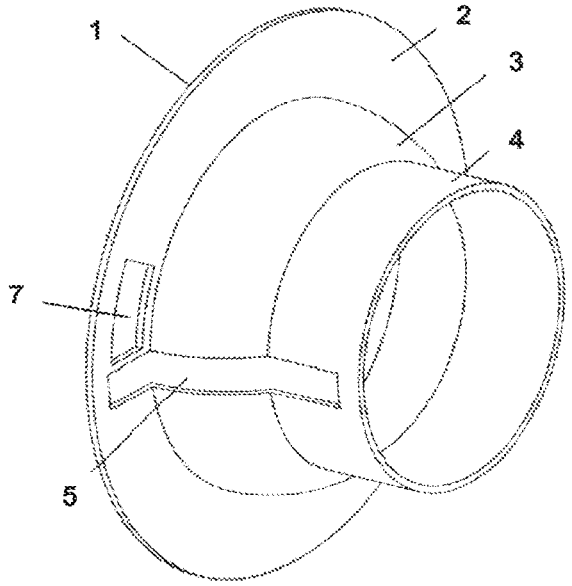
FIG. 1 is a perspective view of a stator.

FIG. 1 shows a stator 1 of a rotary piston and cylinder device. The stator comprises three walls 2, 3 and 4. Specifically, there is provided a planar or flanged wall 2, a curved wall 3 and a cylindrical wall 4. The stator 1 comprises a slot 5 which is provided to receive a shutter 12, described below whose purpose is to divide an annular cylinder space 6 formed between the stator 1 and a rotor 8.

A port 7 is provided in the wall 2 of the stator. Other ports may also be provided in the other walls 3, 4 either instead of or in addition to the port 7.

Figure 2:
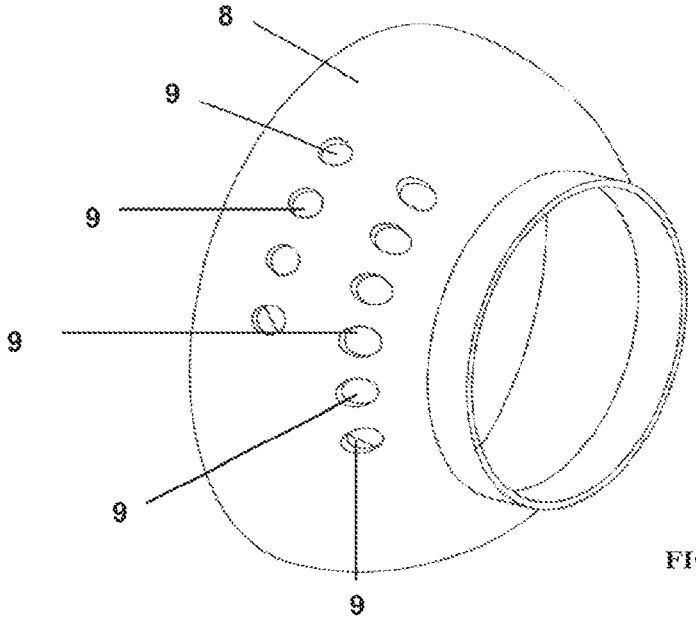
FIG. 2 is a perspective view of a rotor.

FIG. 2 shows the rotor 8, which comprises a dished ring. The rotor 8 fits over the stator 1 to define an annular cylinder space 6. The rotor 8 is provided with an array of holes collectively forming a port 9. The port 9 can correspond with a further port in an outer stator (not shown), which comprises a structure arranged to be outermost of both the stator 1 and the rotor 8, to form a valved port. Alternately, another form of valving or porting may be used.

Figure 3:
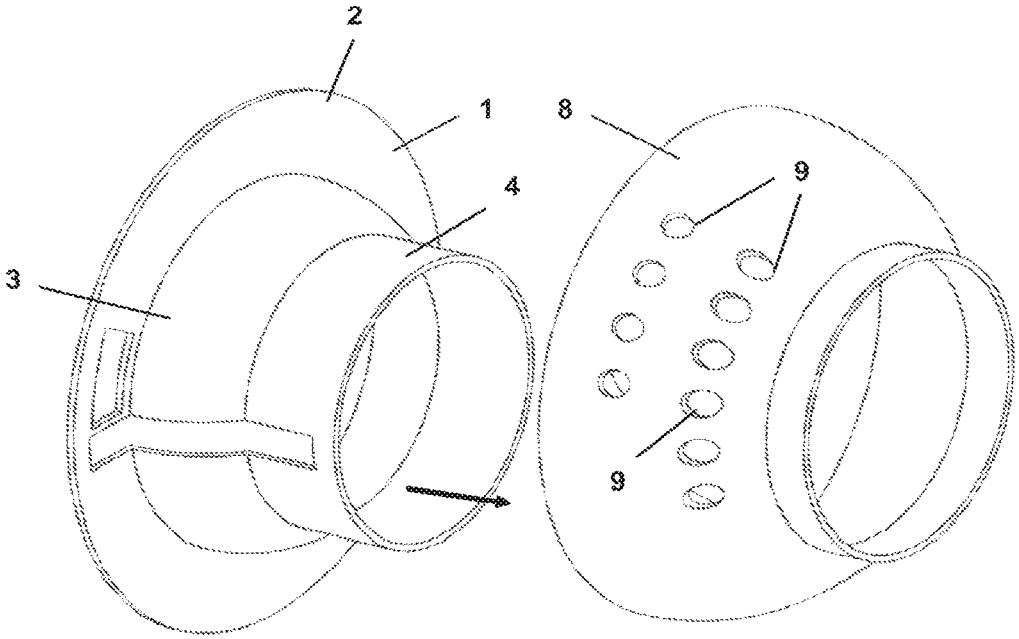
FIG. 3 is a perspective view of a rotor and a stator.

With reference now to FIG. 3 there is the rotor 8 and the stator 1. As shown by the arrow, the stator is urged towards the rotor 8, and the walls 3 and 4 are received thereby.

Figure 4:
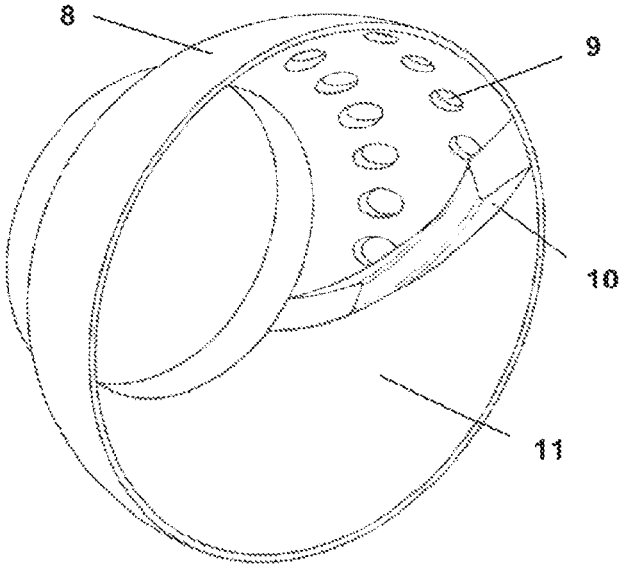
FIG. 4 is a perspective view of rotor.

FIG. 4 shows another view of the rotor 8. A piston 10 is attached to an inner surface 11 of the rotor 8. The piston 10 partitions the annular cylinder space 6 which is formed by the inner surfaces of the walls 2, 3 and 4 and the inner surface 11 of the rotor ring 8.

Figure 5:
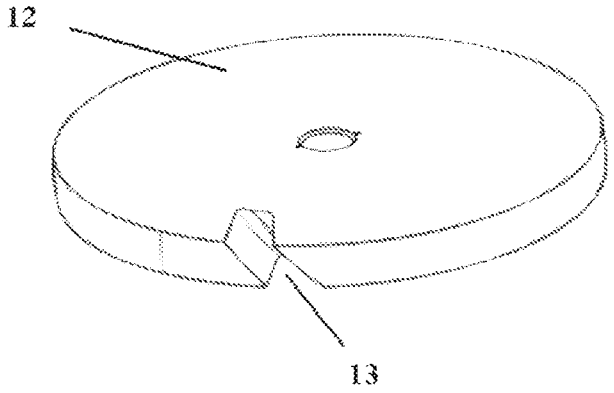
FIG. 5 is a perspective view of a shutter.

FIG. 5 shows a shutter 12 which is accommodated in the slot 5 in the stator 1 and partitions the annular cylinder space 6. The shutter is provided with a slot 13 which allows the piston 10 to pass therethrough. As described below a transmission assembly is provided to synchronise the rotation of the rotor 8 and the shutter 12.

Figure 6:
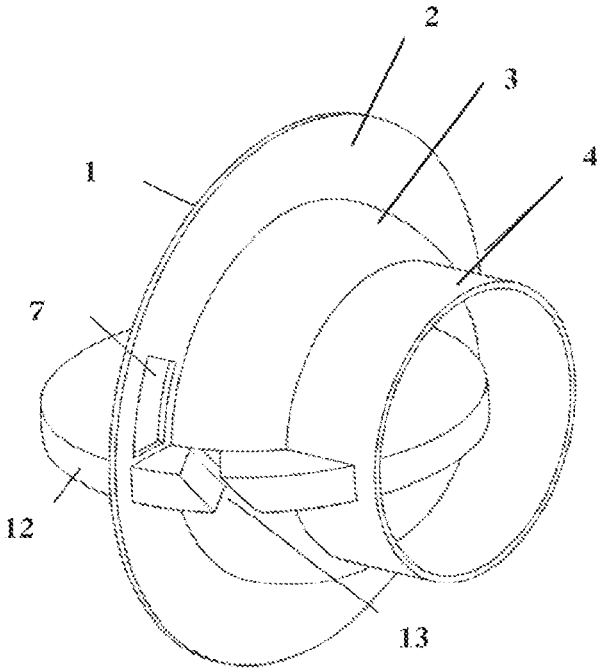
FIGS. 6 and 7 are perspective views of stator and a shutter.

FIG. 6 shows the shutter 12 in situ in the slot 5 of the stator 1, dividing the annular cylinder space 6.

Figure 7:
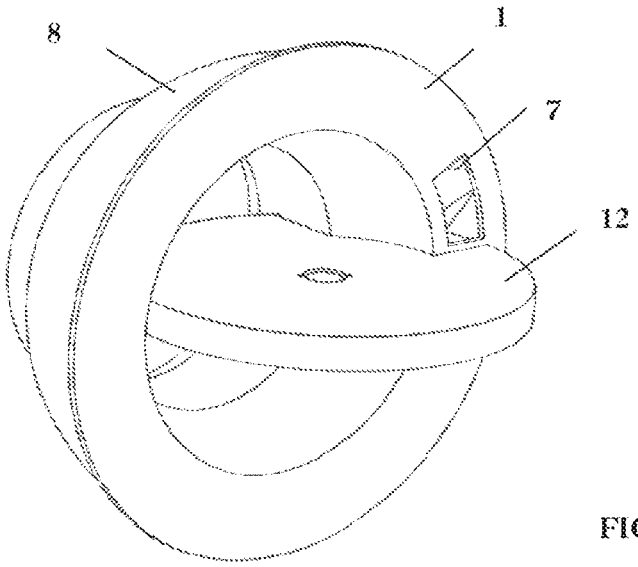

FIG. 7 shows a reverse angle view of the shutter 12, the stator 1 and the rotor 8 in an assembled condition. The port 7 in the stator 1 can also be seen.

Various embodiments of the transmission assemblies suitable for the rotary piston and cylinder device set out above are now described.

Figure 8:
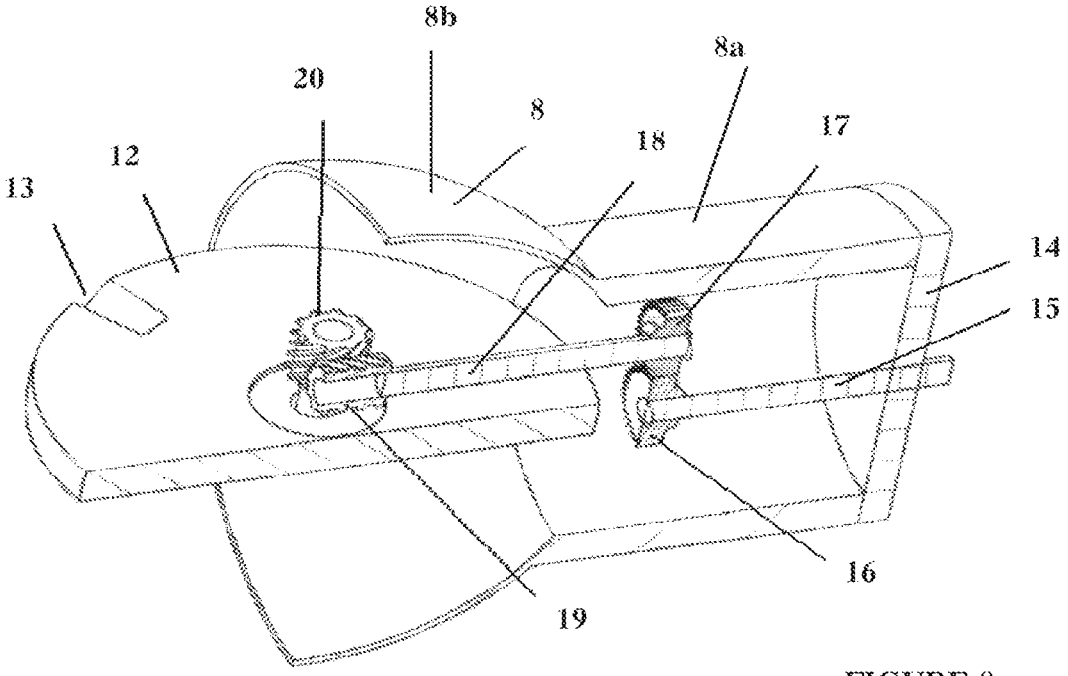
FIG. 8 is a perspective cross-sectional view of a rotor provided with a transmission assembly.
Figure 9:
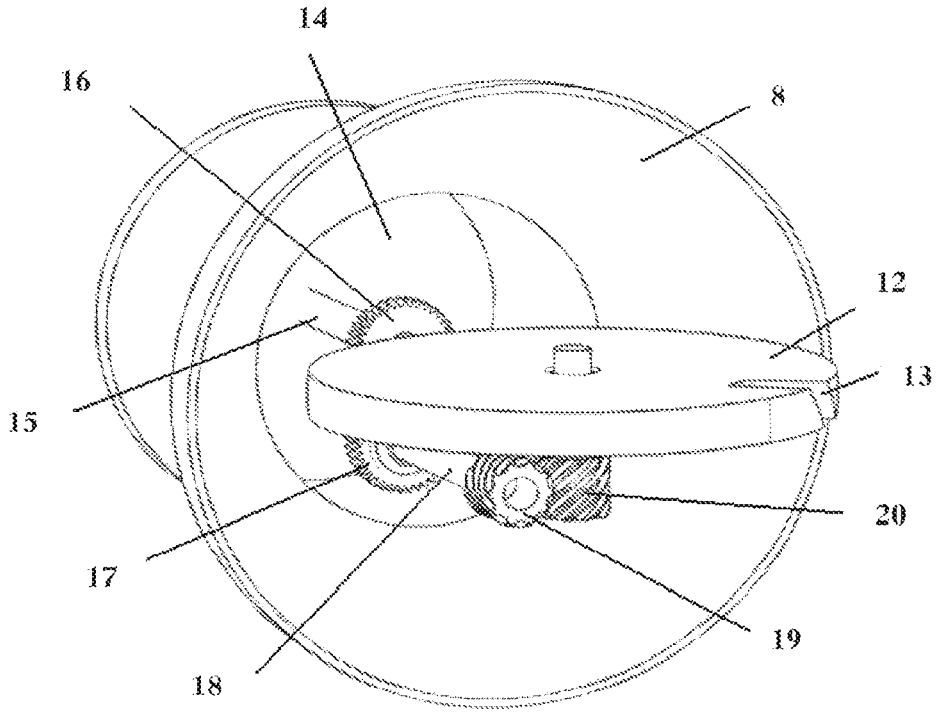
FIG. 9 is a perspective view of a rotor provided with a transmission assembly.

FIGS. 8 and 9 show a first transmission assembly for transmission from the rotor 8 to the shutter 12. It is noted that the rotor 8 in these and subsequent figures is shown without the port holes 9 and piston 10 for reasons of clarity.

The rotor 8 comprises a tubular portion 8*a* in the form of a cylinder which extends away from the dished portion 8*b*. At a distal end of the tubular portion there is provided a drive plate 14 which is integral with the rotor 8.

The drive plate 14 is attached to a main drive shaft 15 such that in operation there is no relative rotation between the rotor 8, the drive plate 14 and the main drive shaft 15.

The main drive shaft 15 has a spur gear 16 attached to it. The spur gear 16 meshes with a spur gear 17 which in turn is attached to a secondary shaft 18. A crossed helical gear 19 is also attached to the secondary shaft 18. The crossed helical gear 19 meshes with a further crossed helical gear 20 to drive the shutter 12 either directly or via another shaft or transmission element (not shown). The gear 20 is provided as extending from one side of the shutter 12, and is within the footprint of the shutter.

Figure 10:
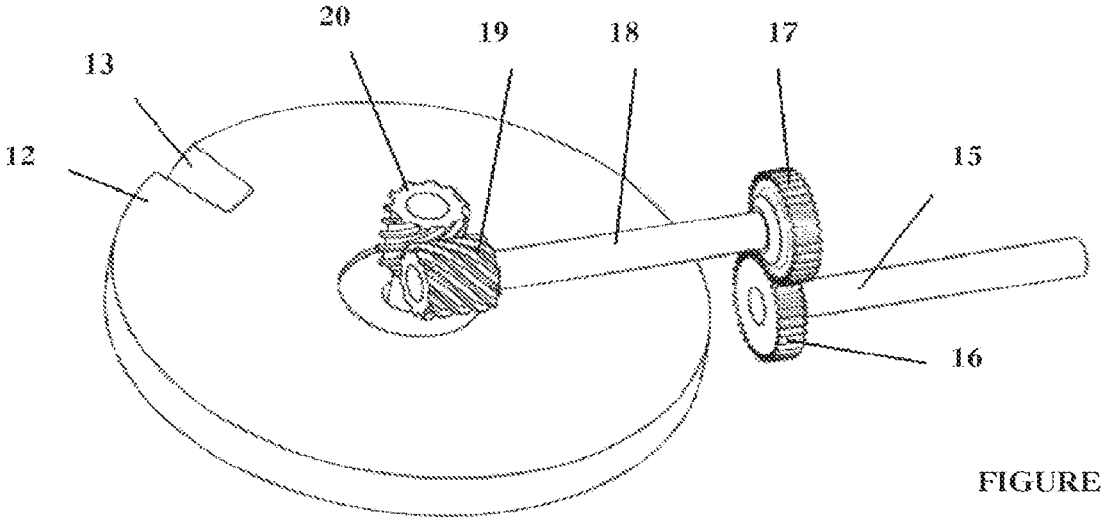
FIG. 10 is a perspective view of a shutter, and transmission assembly of FIGS. 8 and 9.

FIG. 10 shows components of the transmission assembly of FIGS. 8 and 9 in which the rotor 8 and drive plate 14 have been omitted for clarity.

Figure 11:
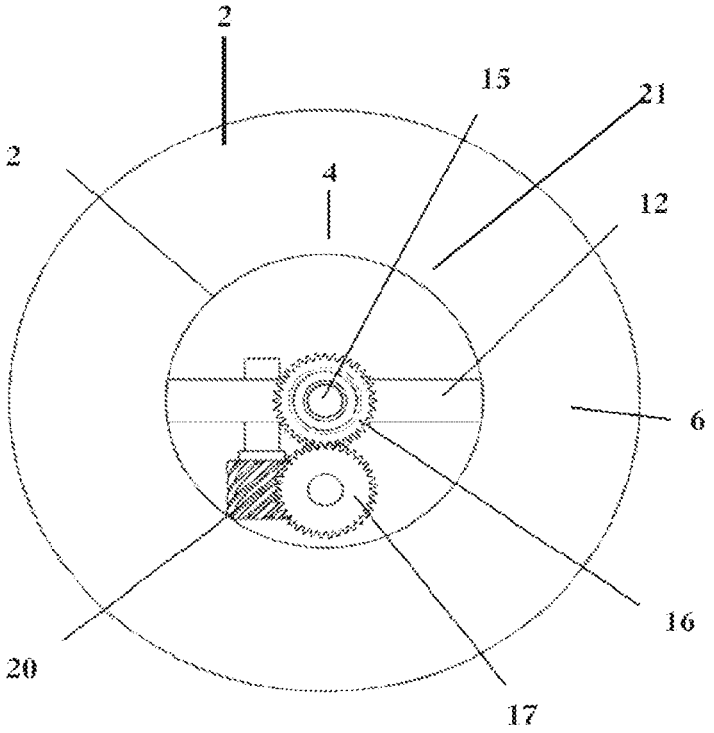
FIG. 11 is a front elevation of the shutter and transmission assembly of FIG. 10.

FIG. 11 shows a further view of components of the transmission assembly of FIGS. 8 and 9 as would be seen looking from the drive plate 14 towards the shutter 12.

It is clear that the packaging, ie the volumetric arrangement, of the transmission arrangement (in this case formed in part by the gear pairs 16 and 17 and 19 and 20) is related to the available space for the annular cylinder space 6. It is beneficial to maximise the annular cylinder space for a given overall size of device.

As an alternative, the drive plate 14 shown in FIG. 8 may be a separate part to the rotor 8 fixed together in such a way that in operation the drive plate 14 and rotor 8 cannot rotate relative to one another.

As a further alternative, the drive plate 14 may include an adjustment mechanism so that the relative rotational position of the rotor 8 and the drive plate 14 can be adjusted. The effect of this adjustment is to allow the timing between the piston 10 and the slot 13 in the shutter 12 to be changed. Specifically the adjustment mechanism allows the relative position of the piston 10 and the slot 13 of the shutter 12 to be adjusted. As the piston 10 passes through the shutter one face of the piston seals against the slot 13. The adjustment mechanism allows the sealing gap to be adjusted after assembly of the device (to adjust the piston to slot clearance and take up any manufacturing tolerances). This type of adjustment mechanism is feasible for use with all of the transmission arrangements set out herein.

Figure 12:
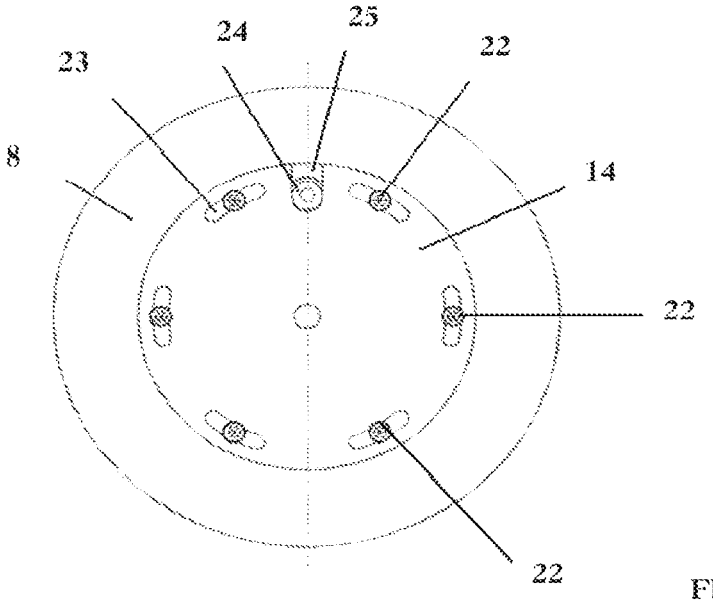
FIG. 12 is a front elevation of an adjustment mechanism.
Figure 13:
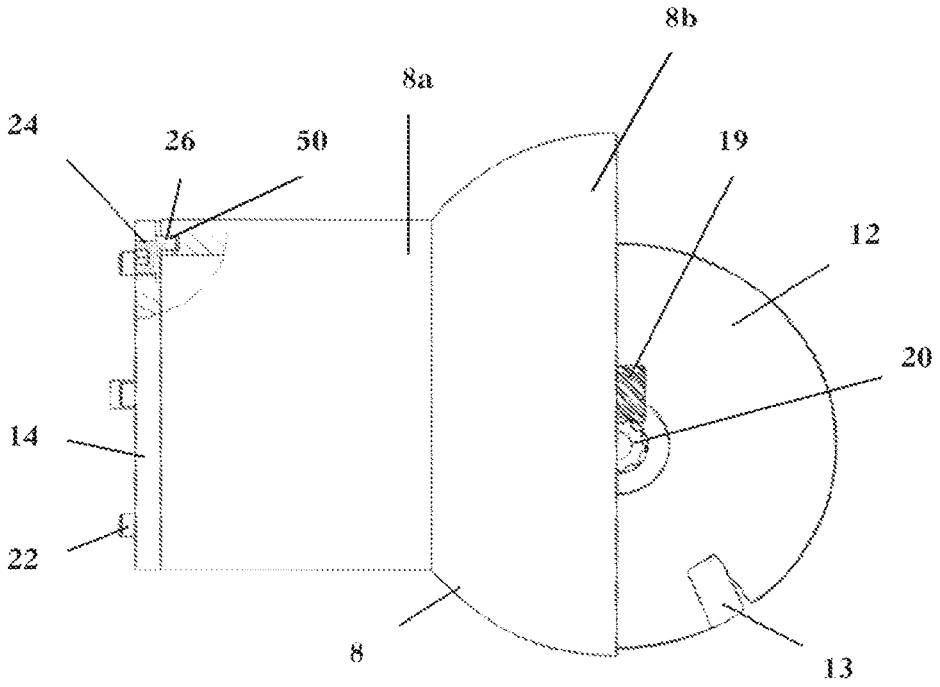
FIG. 13 is a side elevation with partial cross section of a rotor and shutter of a rotary piston and cylinder device comprising the adjustment mechanism of FIG. 12, FIGS. 14*a* and 14*b* are perspective views of a component of the adjustment mechanism of FIG. 12.

FIGS. 12 and 13 show an example of a separate (ie non-integral) drive plate 14 attached to the rotor 8 by a ring of bolts 22. In the embodiment shown the bolts 22 pass through slots 23 in the drive plate 14 into holes in the tubular portion 8*a* of the rotor 8. When tightened the bolts 22 clamp the drive plate 14 to the rotor 8 preventing relative rotation therebetween. When the bolts 22 are loosened the drive plate 14 can rotate, as shown by the double-headed arrow, relative to the rotor 8 to allow the timing between the piston 10 and the slot 13 in the shutter 12 to be adjusted.

An adjustment component 24 to assist in the adjustment of the drive plate 14 relative to the rotor 8 is also shown. The adjustment component 24 in FIG. 12 locates in a slot 25 in the drive plate 14. Other methods of clamping the drive plate 14 to the rotor 8 are possible.

The adjustment component 24 comprises an offset or eccentric pin 26 which locates in a hole 50 in the rotor 8, such that as the adjustment component 24 is rotated, the drive plate is urged to move relative to the rotor 8. The component 24 comprises a keying recess 60 which is adapted to receive suitable tool to enable the component to be rotated.

Figure 14A:
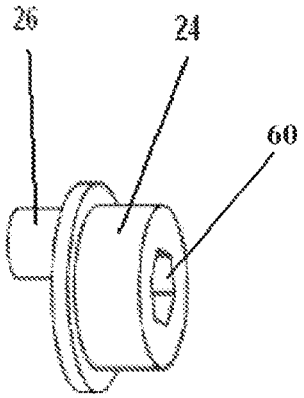
Figure 14B:
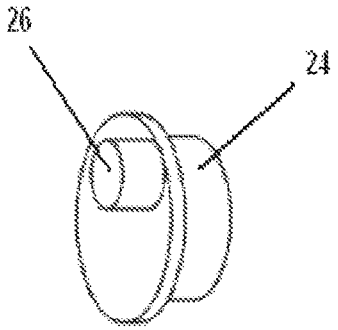

FIGS. 14*a* and 14*b* show two views of the adjustment compartment 24. This is just one example of a mechanism that could be used to enable the relative rotational position of the drive plate 14 and the rotor 8 to be changed.

In the arrangement shown in FIG. 8, the shutter 12 is largely co-incident with a radial line through the annular cylinder space 6 about the cylinder space axis. In that arrangement the axis of the rotor 8, the axis of the annular cylinder space 6 and the axis of the main drive shaft 15 pass through or close to the shutter. This is clearly shown in FIG. 11.

Figure 15:
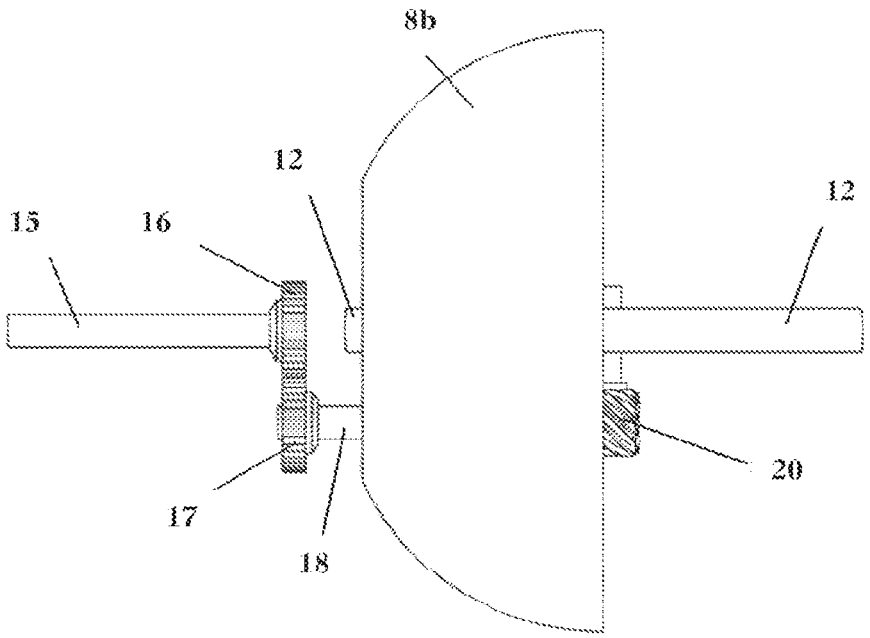
FIG. 15 is a side elevation of the transmission assembly of FIGS. 8 and 9.

FIG. 15 shows a further view of the arrangement of FIG. 8 (in which the tubular portion 8*a* has been removed) showing how the shutter 12 is largely co-incident with the axis of the rotor 8 and with the axis of the main drive shaft 15.

It is possible for the shutter 12 to be repositioned so that it is no longer co-incident with a radial line through the annular cylinder space 6 about the cylinder space axis.

Figure 16:
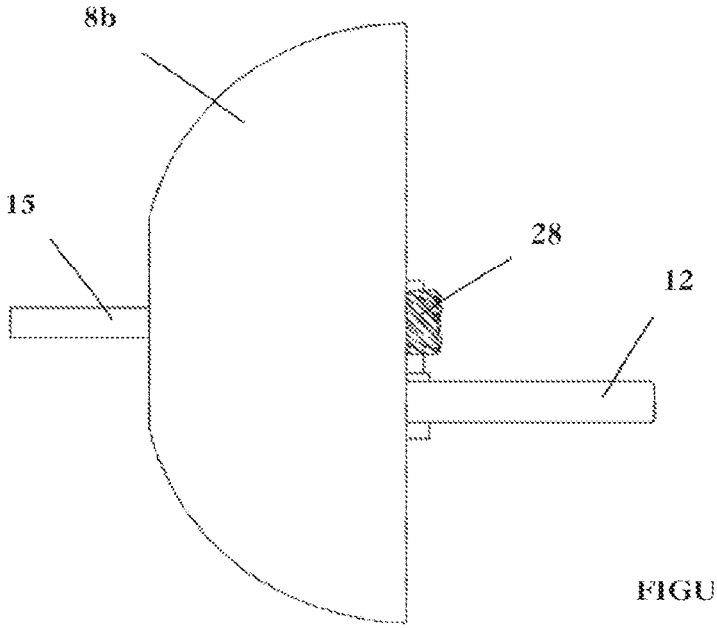
FIG. 16 is a side elevation of a transmission assembly and a rotor.
Figure 17:
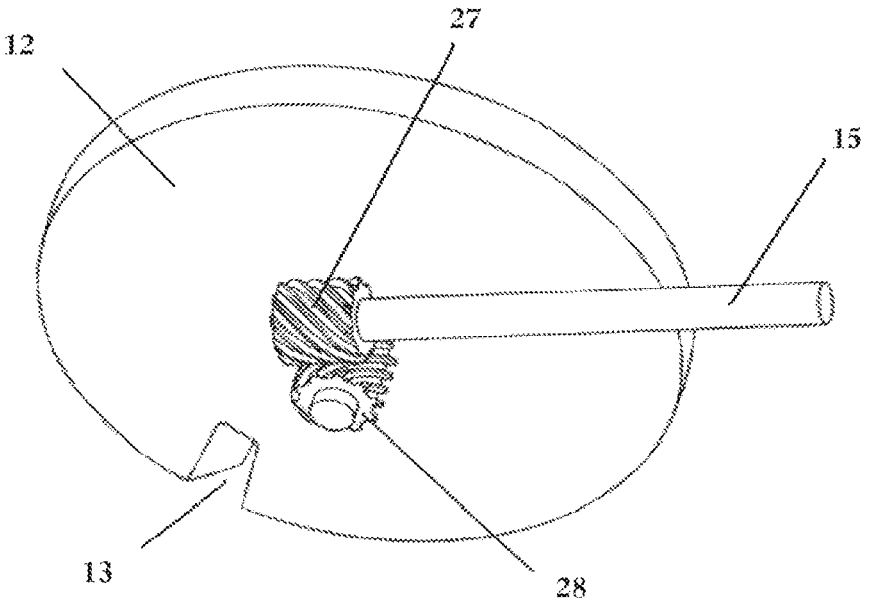
FIG. 17 is a perspective view of components of a transmission assembly.
Figure 18:
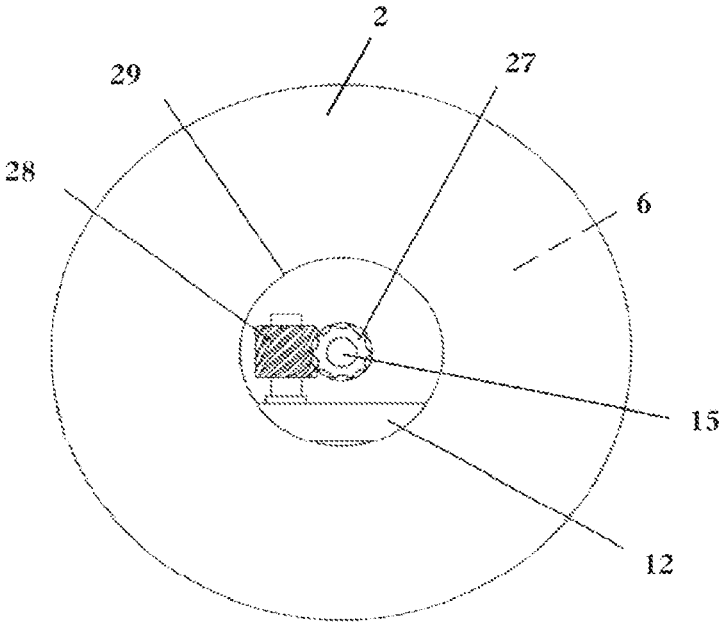
FIG. 18 is a front elevation of a transmission assembly, a shutter and a stator.

If the shutter is moved as described it is possible to modify the layout shown in FIG. 8 and omit one of the gear pairs 16, 17 and the secondary shaft 18. FIGS. 16, 17 and 18 show an alternative to the arrangement shown in FIG. 8 in which the shutter 12 has been repositioned as described above and the transmission means simplified from that of the arrangement shown in FIG. 8. The view in FIG. 16 is equivalent to that of FIG. 15 and clearly shows how the shutter 12 has been moved from the arrangement of FIG. 8. A crossed helical gear 28, shown in FIG. 16, is the equivalent of the crossed helical gear 20 in the arrangement of FIG. 8

FIG. 17 shows another view of the arrangement described in FIG. 16. The view shown in FIG. 17 is similar to the view of the arrangement of FIG. 8 shown in FIG. 10. A crossed helical gear 27 is the equivalent of the crossed helical gear 19 in the arrangement of FIG. 8. The crossed helical gear 28 is the equivalent of the crossed helical gear 20 in the arrangement of FIG. 8.

FIG. 18 shows a representation of the arrangement shown in FIG. 16 in which the circle 29 represents the inner wall 4 defining part of the annular cylinder space 6.

It is clear that the packaging of the transmission arrangement (in this case formed in part by the gear pair 27 and 28) is related to the available space for the annular cylinder space 6.

The packaging benefits shown in FIG. 18 can be compared to FIG. 11 which shows a similar view of the arrangement of FIG. 8. It will be appreciated that the circle 29 in FIG. 18 is equivalent to the circle 21 in FIG. 11.

The arrangement shown in FIG. 8 uses a pair of spur gears 16 and 17 and a pair of crossed helical gears 19 and 20 as part of the transmission from the rotor 8 to the shutter 12.

Figure 19:
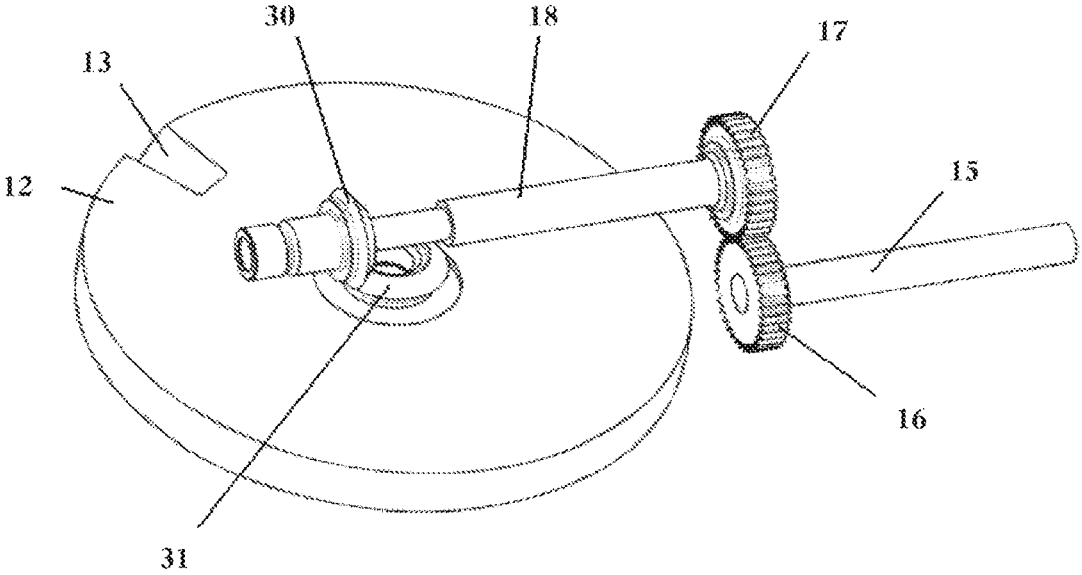
FIGS. 19 to 22 are perspective views of various shutter and transmission assemblies.

In an alternative arrangement shown in FIG. 19, the crossed helical gears 19 and 20 of the arrangement shown in FIG. 8 have been replaced with a pair of bevel gears 30 and 31. It will be appreciated that the teeth of the bevel gears have been omitted for reasons of clarity. The bevel gears 30 and 31 can allow higher rotational speed and lower transmission losses than the crossed helical gears 19 and 20 of the arrangement shown in FIG. 8.

Figure 20:
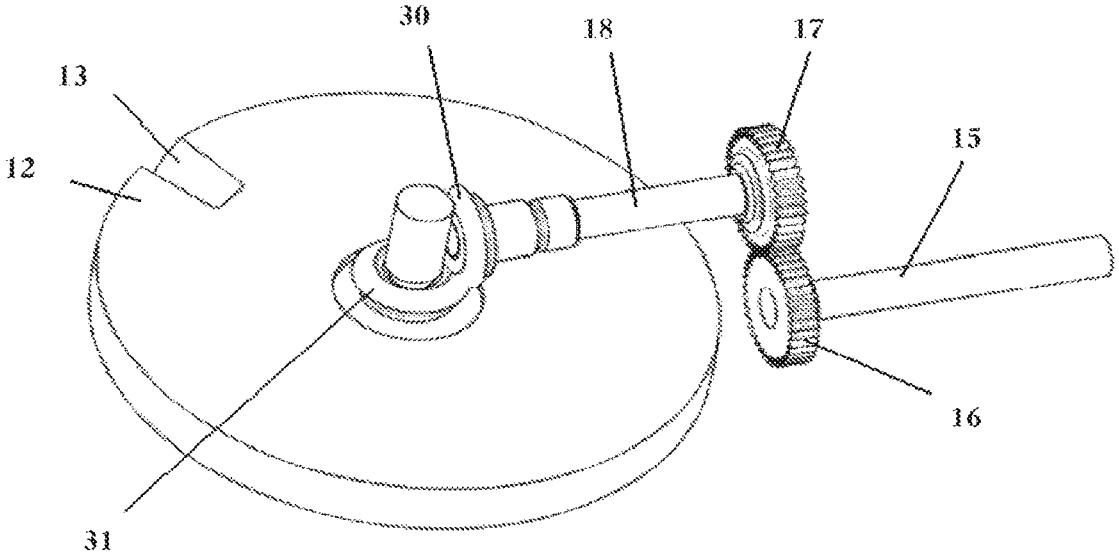

FIG. 20 shows an alternative arrangement closely based on FIG. 19 in which the bevel gear 30 has been re-positioned on the secondary shaft 18. In different layouts of the rotary piston and cylinder device set forth it may be beneficial to use either the arrangement shown in FIG. 19 or that shown in FIG. 20. One example would be to ensure that the gears are below the shutter so that gravity tends to draw any lubricant away from the shutter, the arrangement shown in FIG. 19 or FIG. 20 would be chosen dependant on the preferred direction of rotation of the shutter. It will be appreciated that the directions of rotation of the shutter and rotor determine the angle at which the piston 10 is orientated on the rotor.

Figure 21:
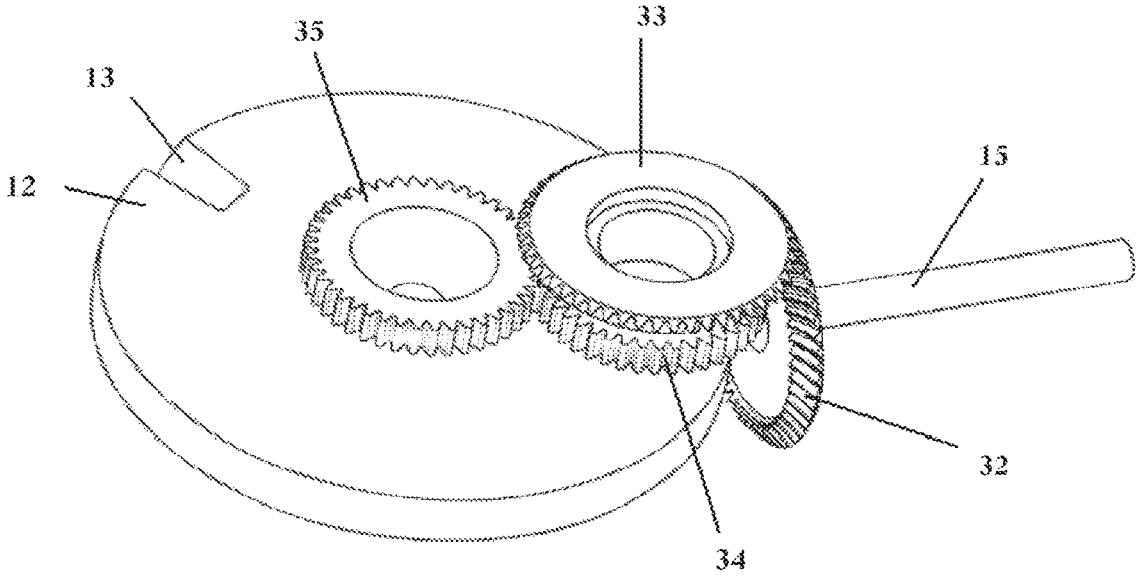

FIG. 21 shows an alternative arrangement related to that of FIG. 19 and FIG. 20. The arrangement shown in FIG. 21 comprises a pair of spur gears 34 and 35 and a pair of bevel gears 32 and 33 as part of the transmission between the rotor 8 and the shutter 12. In the arrangement shown the main shaft 15 has a bevel gear 32 attached to it. This bevel gear 32 meshes with a further bevel gear 33 which is directly coupled to a spur gear 34. The coupling between the bevel gear 33 and the spur or helical gear 34 may be by a short shaft, or the gears may be directly fixed to one another as an assembly, or there may be another method of fixing them so that they cannot rotate relative to one another. The spur gear 34 meshes with a further spur gear 35 which drives the shutter 12 either directly or via a shaft or other transmission means.

The layout shown in FIG. 21 omits the secondary shaft 18 of the arrangements shown in FIGS. 19 and 20. Omitting the secondary shaft provides the advantage of increasing the torsional stiffness of the transmission assembly.

Furthermore, FIG. 21 allows the use of larger gears than the assemblies shown in FIGS. 19 and 20 within a similar package space within the annular cylinder space 6. The use of larger gears can enhance the transmission accuracy and so increase the accuracy of timing between the piston 10 and the slot 13 in the shutter 12.

An alternative assembly to that shown in FIG. 21 reverses the positions of the spur gear 34 and the bevel gear 33 so that the bevel gear 33 is closer to the shutter 12 face than the spur gear 34. This reduces the size of the bevel gears, but may aid packaging in some embodiments.

Figure 22:
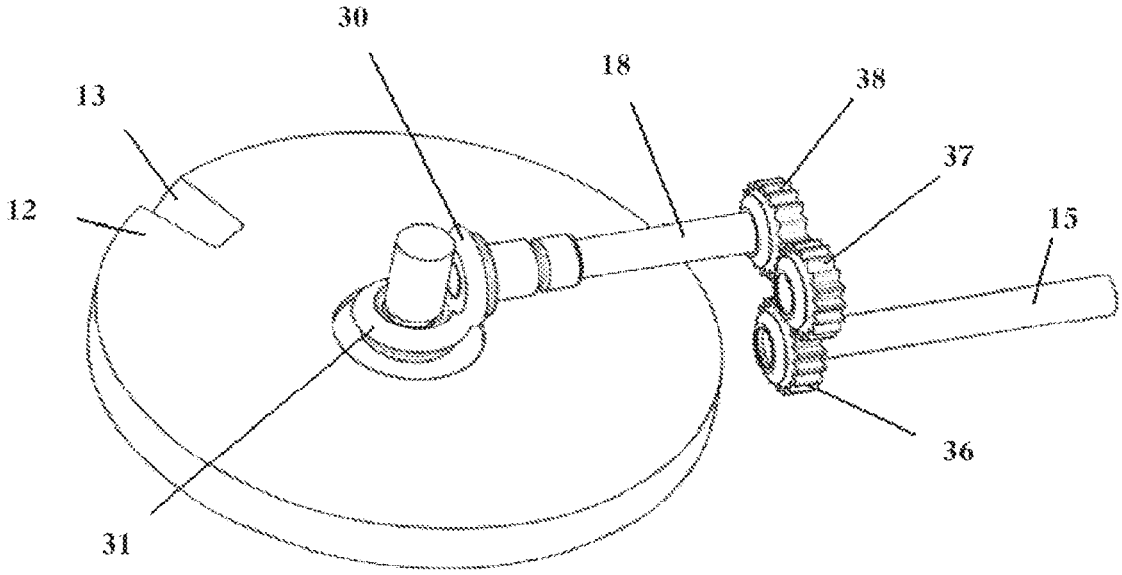

FIG. 22 shows a further alternative to the arrangement shown in FIG. 20. In FIG. 22, the pair of spur gears 16 and 17 of the arrangement shown in FIG. 20 have been replaced with three spur gears 36, 37 and 38. This arrangement can offer a small improvement in the packaging of the spur gears but at the financial expense of an extra gear.

The arrangement of spur gears 36, 37 and 38 in FIG. 22, could also replace the spur gears 16 and 17 in the arrangement shown in FIG. 8 or in the arrangement shown in FIG. 19.

As a further alternative the pair of spur gears 16 and 17 in the arrangement shown in FIG. 8, in the arrangement shown in FIG. 19 or in the arrangement shown in FIG. 20 or the pair of spur gears 34 and 35 of the arrangement shown in FIG. 21 could be replaced with oval, elliptical or non-circular gears. The geometry of piston 10 and of the slot 13 in the shutter means can be changed with non-circular gears which can offer benefits in some arrangements. Possible benefits include improved sealing between the piston 10 and the slot 13 as the piston 10 passes through the shutter 12. In turn, one of the reasons for this improved sealing could be a change in shape of the blade due to the change in gear ratio. A further advantage is that the non-circular gears can be configured so that the transmission is accelerating or decelerating around the point that the piston 10 passes through the shutter 12, taking up backlash within the gears of the transmission.

Figure 23:
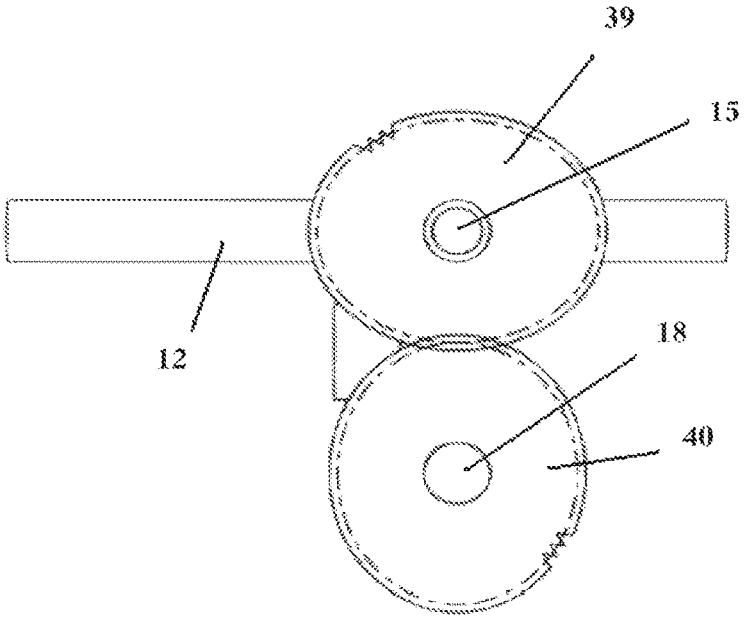
FIGS. 23 and 24 show components of a transmission assembly.

FIG. 23 shows a pair of non-circular gears 39 and 40 that could be used to replace the spur gears 16 and 17 of the arrangements shown in FIG. 8, FIG. 19 or FIG. 20. It will be appreciated that only some of the teeth of each of the gears are shown for the sake of simplicity of presentation.

Figure 24:
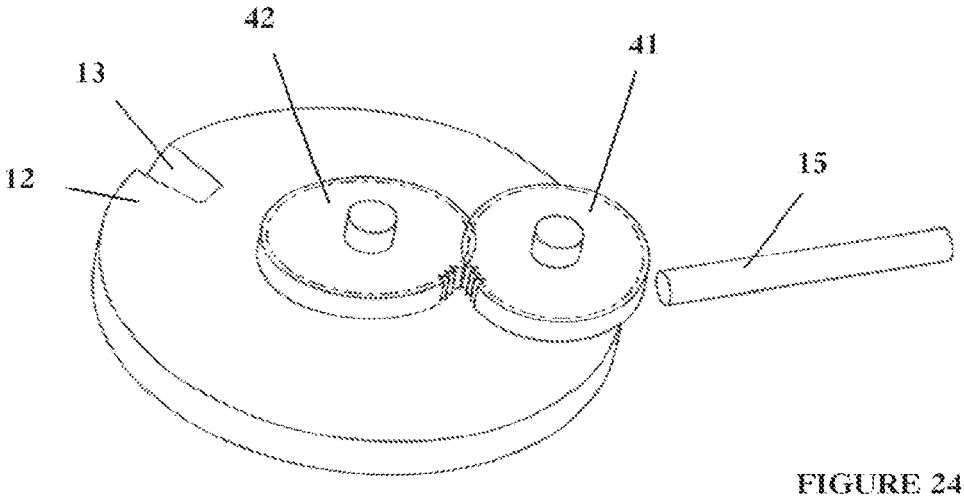

FIG. 24 shows a pair of non-circular gears 41 and 42 that could be used to replace the spur gears 34 and 35 of the arrangement shown in FIG. 21.

In all of the transmission assemblies described above a single piston 10 is attached to the rotor 8 and a single slot 13 is provided in the shutter 12. This means that the overall drive ratio (or average drive ratio in the case of the oval gears) of the transmission means between the rotor 8 and the shutter 12 is 1:1.

In the arrangements described above with more than one gear pair (all apart from the arrangement of FIG. 16), the individual gear pairs may have different gear ratios, while still giving an overall 1:1 ratio for the transmission.

Considering the arrangement shown in FIG. 19, the spur gear 16 may have twenty five teeth and the spur gear 17 may have twenty three teeth giving a drive ratio for this pair 16 and 17 of gears of 25:23. In the same example if the bevel gear 30 has twenty three teeth and the bevel gear 31 has twenty five teeth the drive ratio for this pair 30 and 31 of gears is 23:25. The overall transmission ratio is still 1:1 but the individual gear pairs have different ratios. This type of arrangement is generally considered as best practice because the same teeth do not mesh on each rotation, and is generally referred to as 'hunting tooth'. In the transmission arrangements described above, however, there is a benefit in going against this best practice design and ensuring that the transmission ratio of all gear pairs in the transmission from the rotor 8 to the shutter 12 is 1:1, not just the overall transmission ratio. If the transmission ratio of all gears in the transmission means is 1:1, the same teeth in all gears will mesh every rotation. This allows higher accuracy in the timing between the rotor 8 and the shutter 12 at the point that the piston 10 passes through the slot 13 in the shutter 12. The potential for increased gear wear of this type of arrangement is reduced in the rotary piston and cylinder device set forth as the transmission would typically be expected to be relatively lightly loaded.

Figure 25:
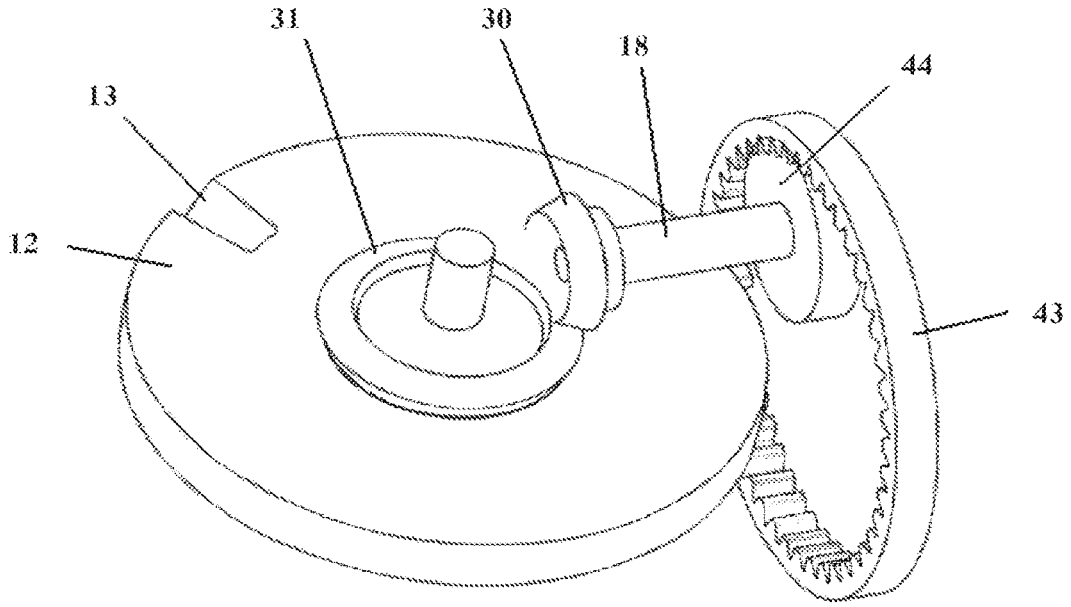
FIG. 25 is a perspective view of a shutter and a transmission assembly.
Figure 26:
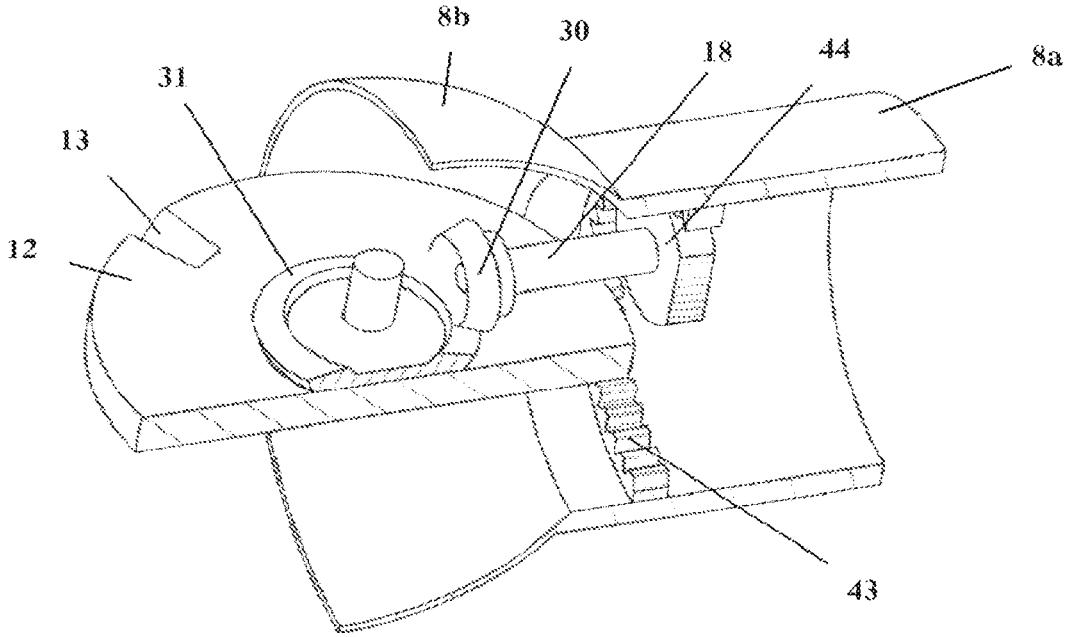
FIG. 26 is a perspective cross sectional view of the shutter and transmission assembly of FIG. 25, in situ with a rotor.
Figure 27:
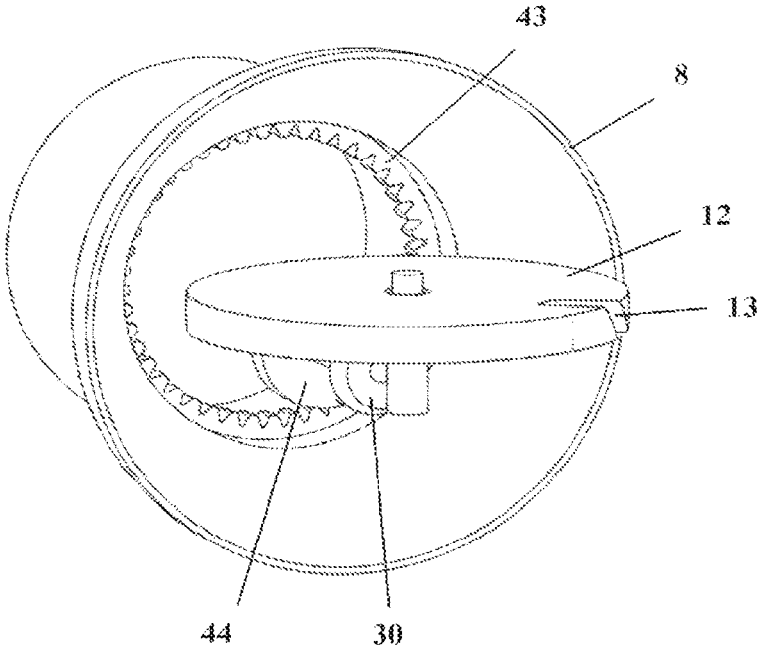
FIG. 27 is a perspective view of the shutter and transmission assembly of FIG. 2, in situ with a rotor.

A further arrangement related to that shown in FIG. 20 is shown in FIGS. 25, 26 and 27. In the arrangement shown in FIG. 25, the spur gears 16 and 17 have been replaced with a internal or ring gear 43 and mating gear 44. As shown in FIG. 26 the ring gear 43 is attached to an inner surface of the tubular portion 8*a* of the rotor 8. The tooth form of these gears may be straight or helical or of some other form. In this arrangement the overall transmission ratio can be 1:1 but it is not possible for the transmission ratios of the individual gear pairs to be 1:1. This arrangement offers packaging benefits in particular embodiments.

In any of the arrangements described above where spur gears are employed, these may be replaced by helical gears.

In any of the arrangements described above employing bevel gears, the bevel gears may be either straight cut, or helical or employ some other tooth form.

In any of the arrangements described above employing crossed helical gears, the crossed helical gear pair could be replaced by a hypoid gear pair.

The shutter may include an axis of rotation which is different to that of the rotor, but the axes are not orthogonal to one another. The transmission assembly comprises a bevelled gear, which meshes with a bevel gear, the bevel gear being connected to the shaft. The bevel gears may be arranged in a hypoid form.

Alternative embodiments may comprise any of a large range of transmission components including belts, chains, flexible joints, such as universal joints, or any combination of the aforementioned.

A rotary piston and cylinder device comprising any of the transmission assemblies described above achieves desirable requirements for packaging, transmission accuracy and transmission stiffness characteristics.

The invention claimed is:

1. A rotary piston and cylinder device, comprising:

a rotor, the rotor comprising a piston, the rotor is arranged to rotate about an axis of rotation, a stator, the rotor and the stator defining an annular working chamber, and a rotor surface in part defining the working chamber, the device further comprising a rotatable shutter which serves to divide the working chamber, but which comprises a slot to nevertheless allow passage of the piston, and the rotor surface being a concave surface which faces generally radially inwards towards the axis of rotation of the rotor, the piston extending from the concave surface and the concave surface in part defining the working chamber.

2. A rotary piston and cylinder device as claimed in claim 1 comprising:

a transmission assembly comprising a first gear and a gear sub-assembly, the first gear connectable to the rotatable shutter of the device, the first gear extending from a side of the shutter, the shutter having an axis of rotation which is non-intersecting in relation to the axis of rotation of the rotor, and the stator comprising an opening through which the shutter is receivable in the working chamber so as to intersect said working chamber, and the first gear connected to the gear sub-assembly which converts rotation to an axis of rotation different from the axis of rotation of the shutter, and the gear sub-assembly comprises a second gear which meshes with the first gear and the second gear has an axis of rotation parallel to that of the first gear.

3. A rotary piston and cylinder device as claimed in claim 2 in which the first gear is located radially inwardly of the shutter.

4. A rotary piston and cylinder device as claimed in claim 2 in which an axis of rotation of at least part of the gear sub-assembly is substantially orthogonal to the axis of rotation of the shutter.

5. A rotary piston and cylinder device as claimed in claim 2 in which the gear sub-assembly comprises a shaft extending away from the shutter, wherein the shaft is either connected to the first gear by way of a gear of the shaft or is connected to the first gear by at least one intermediate gear.

6. A rotary piston and cylinder device as claimed in claim 2, the gear sub-assembly arranged to connect to the rotor, the rotor configured to at least partially surround the shutter.

7. A rotary piston and cylinder device as claimed in claim 6 in which the gear sub-assembly comprises an internal gear connectable to an internal surface of the rotor.

8. A rotary piston and cylinder device as claimed in claim 6, the gear sub-assembly arranged to connect to a distal end portion of the rotor.

9. A rotary piston and cylinder device as claimed in claim 7 in which the gear sub-assembly comprises a shaft arranged to connect to a drive plate connected to the rotor.

10. A rotary piston and cylinder device as claimed in claim 2, wherein, in situ, the first gear lies within a footprint of the shutter.

11. A rotary piston and cylinder device as claimed in claim 2 in which the first gear comprises spur teeth, which meshes with the second gear of the gear sub-assembly comprising spur teeth.

12. A rotary piston and cylinder device as claimed in claim 2 in which the gear sub-assembly comprises a first bevel gear and a spur gear, the first bevel gear and the spur gear arranged coaxially, and the gear sub-assembly further comprises a second bevel gear, which meshes with the first bevel gear.

13. A rotary piston and cylinder device as claimed in claim 2, in which the first gear is of non-circular shape, and meshes with the gear of the gear sub-assembly which is also of non-circular shape.

14. A rotary piston and cylinder device as claimed in claim 2 in which meshing gear pairs have a gear ratio of 1:1.

15. A rotary piston and cylinder device as claimed in claim 2, wherein the rotor is provided with a housing portion which extends away from the working chamber, the working chamber is substantially co-axial with the axis of rotation of the rotor, and the housing portion is rotationally connected to the transmission assembly to transmit rotation from the rotor to the rotatable shutter of the device, and the transmission assembly is at least partially enclosed by the housing portion.

16. A rotary piston and cylinder device as claimed in claim 1 wherein at least a portion of the concave surface of the rotor being of a dished ring form.

17. A rotary piston and cylinder device as claimed in claim 15 which comprises an adjustment mechanism which allows the relative orientation of the piston of the rotor to the aperture of the shutter, when the piston is received in the aperture, to be adjusted, wherein the aperture is a slot.

18. A rotary piston and cylinder device as claimed in claim 17 wherein the adjustment mechanism comprises a moveable connection between the transmission assembly and the rotor.

19. A rotary piston and cylinder device as claimed in claim 18 in which the moveable connection is configured to allow pivotable movement between the rotor and the shutter.

20. A rotary piston and cylinder device as claimed in claim 1, wherein the shutter has an aperture, the aperture being only one aperture.

21. A rotary piston and cylinder device as claimed in claim 1, wherein the axis of rotation of the rotor and an axis of rotation of the shutter are offset so as to not intersect.

22. A rotary piston and cylinder device as claimed in claim 1, wherein the axis of rotation of the rotor and an axis of rotation of the shutter are offset such that the rotor and shutter do not rotate around any intersection of the axis of rotation of the rotor and the axis of rotation of the shutter.

23. A rotary piston and cylinder device as claimed in claim 1 wherein the shutter is arranged in an opening to intersect an annular cylinder space at only one region of said annular working chamber.

* * * * *